US006435467B1

(12) United States Patent
Lai

(10) Patent No.: US 6,435,467 B1
(45) Date of Patent: Aug. 20, 2002

(54) CLAMPING DEVICE OF COOLING FAN

(76) Inventor: Yaw-Huey Lai, No. 20-3, Lane 65, Lien Cheng Road, Chung Hu City Taipei Hsien (TW)

( * ) Notice: Subject to any disclaimer, the term of this patent is extended or adjusted under 35 U.S.C. 154(b) by 0 days.

(21) Appl. No.: 09/630,964

(22) Filed: Aug. 2, 2000

(30) Foreign Application Priority Data

Jun. 2, 2000 (TW) ..... 89209723 U

(51) Int. Cl.[7] ..... A47B 97/00

(52) U.S. Cl. ..... 248/500; 165/80.3; 248/303; 248/304

(58) Field of Search ..... 248/500, 302, 248/303, 305, 304; 165/80.3

(56) References Cited

U.S. PATENT DOCUMENTS 2,914,288 A * 11/1959 Beller ..... 248/303
2,919,813 A * 1/1960 Clark ..... 248/303
5,458,309 A * 10/1995 Craven, Jr. et al. ..... 248/302 X
5,678,627 A * 10/1997 Lee ..... 165/80.3
5,730,196 A * 3/1998 Frament ..... 248/303

* cited by examiner

*Primary Examiner*—Ramon O. Ramirez
(74) *Attorney, Agent, or Firm*—Browdy and Neimark, P.L.L.C.

(57) ABSTRACT

A clamping device has an elongated main body which is provided at the longitudinal ends with an insertion portion which is in turn provided with a foot portion. The foot portion is provided with a hooked portion. The clamping device is used to fasten a cooling fan to a cooling device such that the hooked portion catches a retaining hole of one of the cooling fins of the cooling device, and that the insertion portion is removably inserted into one of retaining recesses of the cooling fan.

4 Claims, 2 Drawing Sheets

CLAMPING DEVICE OF COOLING FAN

FIELD OF THE INVENTION

The present invention relates generally to a cooling fan, and more particularly to a clamping device of the cooling fan.

BACKGROUND OF THE INVENTION

The conventional way of fixing a cooling fan on a cooling device is done by drilling a plurality of through holes in the cooling fan and fastening the cooling fan over the cooling fins of the cooling device by a plurality of self-tapping screws, which are put through the through holes of the cooling fan. Another conventional way is to fasten the cooling fan on the base of the cooling device by means of long screws. Such conventional ways as described above are defective in design in that the cooling fins are susceptible to damage by the cooling fan in light of the weight of the cooling fan. In addition, it is time-consuming to mount a cooling fan on the base of the cooling device in view of the fact that the screws can not be easily aligned with the threaded holes of the base, and that the fastening of the screws must be done with caution so as to prevent the cooling fins from being damaged by the screws. The work of drilling the threaded holes in the base of the cooling device results in an increase in the cost of making the cooling device. The base of the cooling device is generally made of aluminum which does not work well with the self-tapping screws.

SUMMARY OF THE INVENTION

The primary objective of the present invention is to provide an efficient device for clamping a cooling fan of a cooling device.

It is another objective of the present invention to provide a cost-effective device for clamping a cooling fan of a cooling device.

It is still another objective of the present invention to provide a clamping device for fastening a cooling fan with a cooling device without causing a damage to the cooling fins of the cooling device.

The clamping device of the present invention has an elongated main body which is provided at both longitudinal ends with an insertion portion which is in turn provided with a foot extending therefrom and having a hooked portion. A cooling fan is mounted on a cooling device such that the hooked portions catch the retaining holes of the cooling fins, and that the insertion portions are removably inserted into the retaining recesses of the cooling fan.

DETAILED DESCRIPTION OF THE INVENTION

Figure 1:
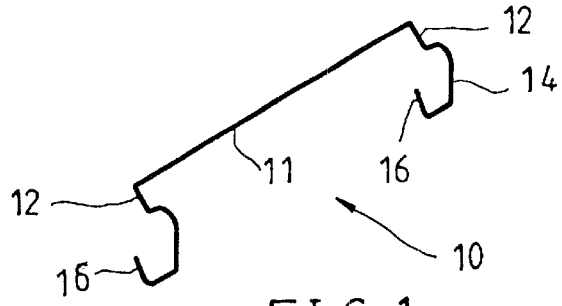
FIG. 1 shows a perspective view of a preferred embodiment of the present invention.
Figure 2:
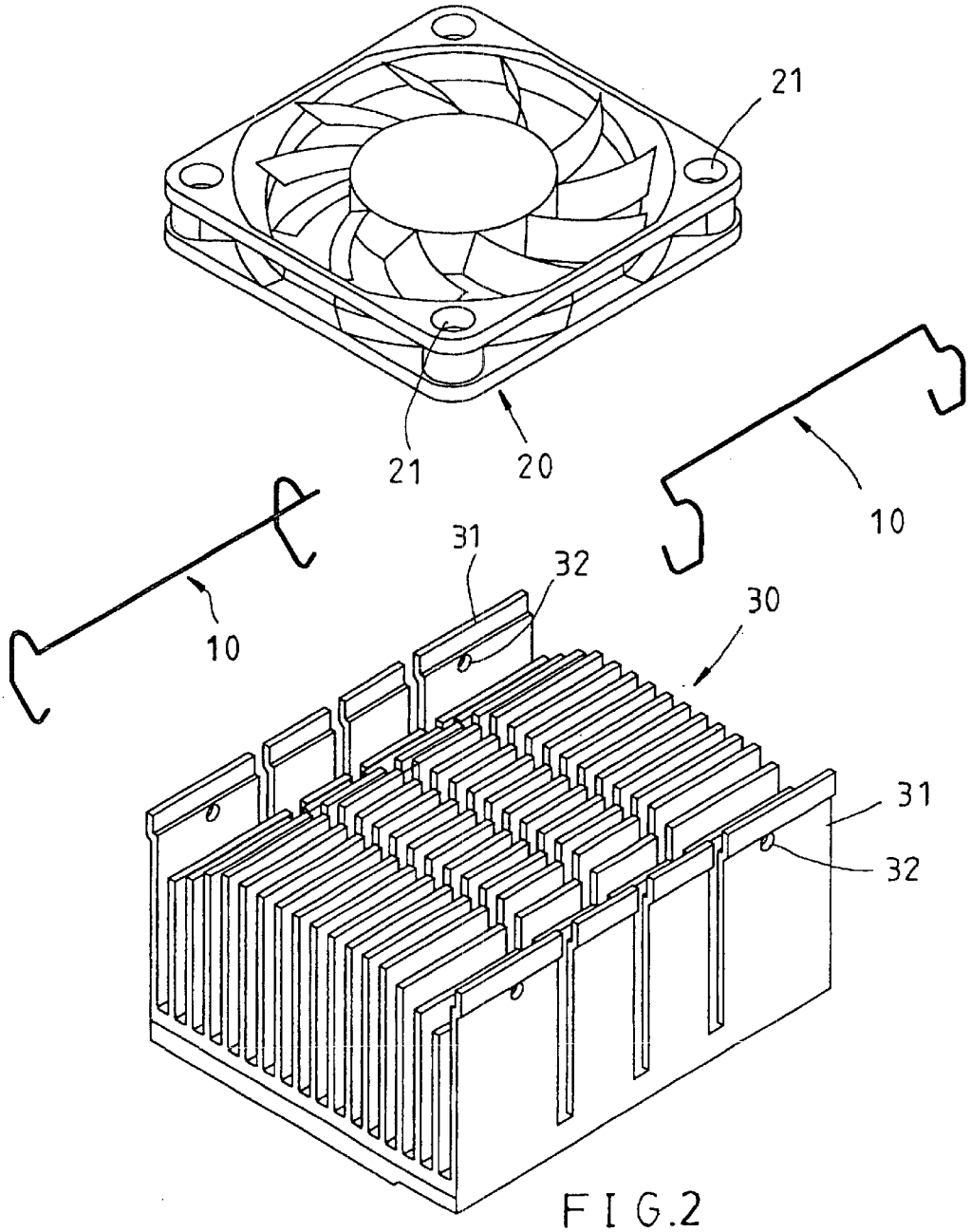
FIG. 2 shows an exploded view of a cooling device in conjunction with the preferred embodiment of the present invention.

As shown in FIG. 1, a clamping device 10 of the preferred embodiment of the present invention has an elongated main body 11 whose both longitudinal ends are curved repeatedly to form into a V-shaped insertion portion 12, which is in turn provided with a foot portion 14. The foot portion 14 has a free end which is provided with a hooked portion 16.

As shown in FIGS. 2–5, the clamping device 10 of the preferred embodiment of the present invention is intended to fasten a cooling fan 20 to a cooling device 30 comprising a plurality of cooling fins 31, with each having a retaining hole 32. The cooling fan 20 is provided with a plurality of retaining recesses 21.

Figure 3:
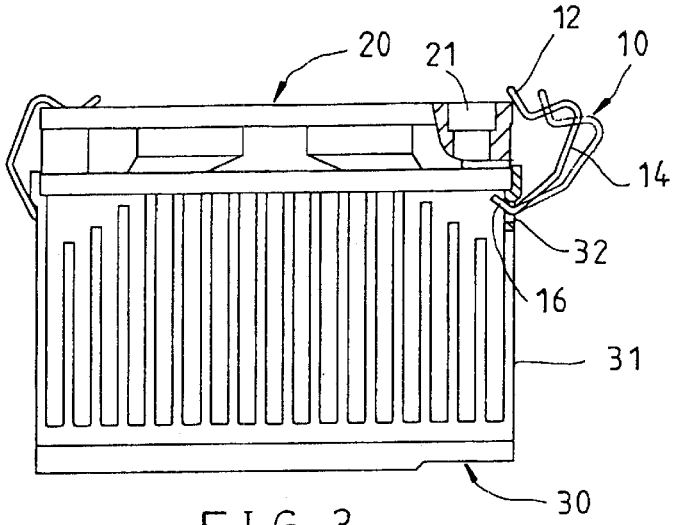
FIG. 3 shows a schematic view of the preferred embodiment of the present invention in action.
Figure 4:
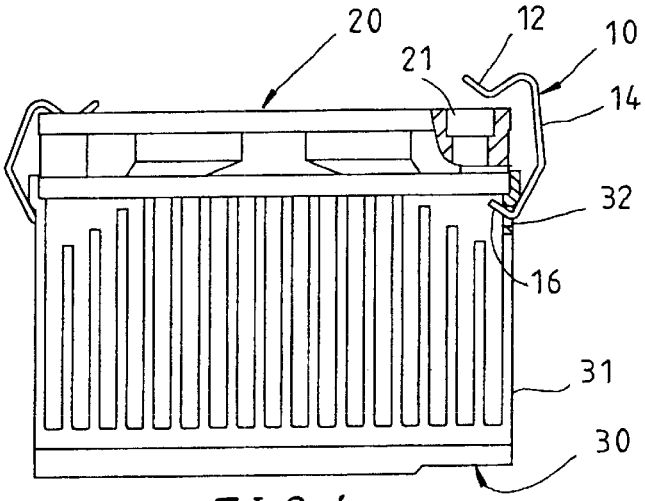
FIG. 4 shows another schematic view of the preferred embodiment of the present invention in action.
Figure 5:
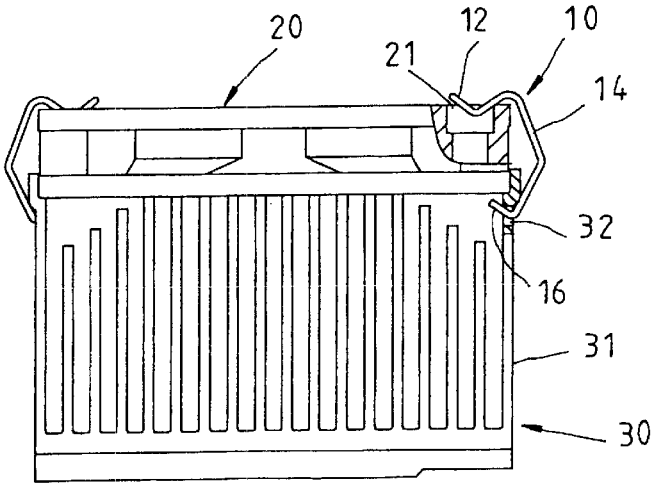
FIG. 5 shows a schematic view of the preferred embodiment of the present invention at work.

The cooling fan 20 is securely mounted on the cooling device 30 by a plurality of the clamping devices 10 of the present invention in such a manner that the hooked portion 16 of each clamping device 10 catches the retaining hole 32 of the cooling fin 31, and that the insertion portion 12 presses against the cooling fan 20, as shown in FIG. 3. Thereafter, the main body 11 is lifted to enable the insertion portions 12 to pass the corners of the cooling fan 20 to enter the retaining recesses 21 of the cooling fan 20, as shown in FIGS. 4 and 5.

The cooling fan 20 can be easily separated from the cooling device 30 by wrenching the main body 11 outwards so as to cause the insertion portions 12 to move out of the retaining recesses 21 of the cooling fan 20.

The clamping device 10 of the present invention is made of an elongated metal bar and is therefore cost-effective. The device 10 of the present invention is efficient.

What is claimed is:

1. A clamping device for fastening a cooling fan to a cooling device, said clamping device having an elongated main body which is straight throughout the length thereof and provided at opposite longitudinal ends thereof with an insertion portion, said insertion portion being provided with a foot portion extending therefrom and having a hooked portion below the insertion portion, whereby said clamping device fastens the cooling fan to the cooling device in such a way that said hooked portion is adapted to catch a retaining hole of one of the cooling fins of the cooling device, and that said insertion portion is adapted to be removably inserted into one of retaining recesses of the cooling fan, wherein said insertion portion is of a V-shaped construction.

2. The clamping device as defined in claim 1, wherein said insertion portion and said hooked portion are formed in a same plane and both the V-shaped construction and hooked portion open upward.

3. A clamping device fastening a cooling fan to a cooling device, said clamping device having an elongated main body which is straight throughout the length thereof and provided at opposite longitudinal ends thereof with an insertion portion, said insertion portion being provided with a foot portion extending therefrom a having a hooked portion below the insertion portion, whereby said clamping device fastens the cooling fan to the cooling device in such a way that said hooked portion catches a retaining hole of one of the cooling fins of the cooling device, and that said insertion portion is removably inserted into one of retaining recesses of the cooling fan, wherein said insertion portion is of a V-shaped construction.

4. The clamping device as defined in claim 3, wherein said insertion portion and said hooked portion are formed in a same plane and both the V-shaped construction and hooked portion open upward.

* * * * *